US010087579B2

(12) United States Patent
Ottosson et al.

(10) Patent No.: US 10,087,579 B2
(45) Date of Patent: Oct. 2, 2018

(54) PROFILE BAR SCREEN FOR DIGESTER VESSELS

(71) Applicant: Valmet AB, Sundsvall (SE)

(72) Inventors: Per-Anders Ottosson, Skoghall (SE); Jerk Söderman, Karlstad (SE)

(73) Assignee: Valmet AB (SE)

( * ) Notice: Subject to any disclaimer, the term of this patent is extended or adjusted under 35 U.S.C. 154(b) by 0 days.

(21) Appl. No.: 15/507,813

(22) PCT Filed: Aug. 27, 2015

(86) PCT No.: PCT/SE2015/050907

§ 371 (c)(1),
(2) Date: Mar. 1, 2017

(87) PCT Pub. No.: WO2016/036299

PCT Pub. Date: Mar. 10, 2016

(65) Prior Publication Data

US 2017/0284022 A1 Oct. 5, 2017

(30) Foreign Application Priority Data

Sep. 1, 2014 (SE) ..... 1451015

(51) Int. Cl.
*D21C 7/08* (2006.01)

(52) U.S. Cl.
CPC ..... *D21C 7/08* (2013.01)

(58) Field of Classification Search
USPC ..... 162/251
See application file for complete search history.

(56) References Cited

U.S. PATENT DOCUMENTS 5,234,550 A * 8/1993 Ekholm ..... B01D 29/014 162/251
5,827,401 A * 10/1998 Backlund ..... D21C 3/24 162/248

(Continued)

FOREIGN PATENT DOCUMENTS

WO 9516817 A1 6/1995
WO 2013105888 A1 7/2013

OTHER PUBLICATIONS

International Search Report for Application No. PCT/SE2015/050907 dated Nov. 30, 2015.
"Chemical Pulping," book 6A (1999), ISBN 952-5216-06-3, p. A537.

*Primary Examiner* — Mark Halpern
(74) *Attorney, Agent, or Firm* — Lerner, David, Littenberg, Krumholz & Mentlik, LLP

(57) ABSTRACT

The invention relates to an improved profile bar screen for draining treatment liquor from a suspension of comminuted cellulose material and treatment liquor in an essentially cylindrical digester vessel. According to the invention is a profile bar screen designed with horizontal support arches 11 with integrated support shoulders 12 only at the outer ends of the support arch which support shoulders rest against the inside of the vessel wall 1. The invention combines the techniques from self-supporting screens with support members of weaker screen designs, avoiding need to make any additional welds in the classified pressure vessel wall of the digester. Installation of new screens in compartments previously equipped with blind plates in checkered screen rows may be done quickly and at less costs during shorter down time of digester.

12 Claims, 8 Drawing Sheets

(56) References Cited

U.S. PATENT DOCUMENTS

| | | | | |
|---|---|---|---|---|
| 6,344,112 | B1 * | 2/2002 | Hernesniemi | D21C 7/00 162/17 |
| 6,889,851 | B1 * | 5/2005 | Isola | D21C 7/00 209/666 |
| 8,980,061 | B2 * | 3/2015 | Vinje | D21C 7/00 162/251 |
| 2003/0095901 | A1 * | 5/2003 | Isola | D21C 7/00 422/217 |
| 2005/0284594 | A1 * | 12/2005 | Nykanen | B07B 1/00 162/55 |

* cited by examiner

PROFILE BAR SCREEN FOR DIGESTER VESSELS

CROSS-REFERENCE TO RELATED PATENT APPLICATIONS

The present application is a national phase entry under 35 U.S.C. § 371 of International Application No. PCT/SE2015/050907 filed Aug. 27, 2015, published in English, which claims priority from Swedish Application No. 1451015-0 filed Sep. 1, 2014, all of which are incorporated herein by reference.

FIELD OF THE INVENTION

The present invention relates to a profile bar screen according to the preamble of claim 1.

A profile bar screen is used for draining treatment liquor from a suspension of comminuted cellulose material and treatment liquor in an essentially cylindrical digester vessel. This type of profile bar screen is used particularly in continuous digester vessels for producing pulp. Such a profile bar screen can be utilized in new reactors built, or used as spare part in old digesters where existing screen plates needs replacement or if increased withdrawal capacity is needed with larger screen area.

BACKGROUND OF THE INVENTION

Today, continuous digesters for instance comprise substantially cylindrical pressure vessels arranged in an upright position. Pressure vessels of continuous pulp digesters are remarkably high, and their diameter can be several meters. For instance, the diameter of the bottom part of a pressure vessel may be 4 m to 15 m, all depending upon production capacity of the digester.

The diameter of such a pressure vessel is usually smaller at the top end of the digester than at its bottom end. However, the diameter of the digester is typically arranged to increase at certain positions in step-outs during the cooking process by means of one or more conical transition sections. The exact positions are defined by process-specific technical grounds and where a change of treatment liquor needs to be made, using withdrawal or extraction screens at these positions. Screens are usually mounted below the above-mentioned step-outs.

Due to the considerable size of a pressure vessel, deviations from theoretical shapes of a cylinder produced during the manufacture of the pressure vessel, are significant. These deviations from the intended circular cross-section cause many problems. One problem arises, for instance, when the inner surface of the pressure vessel is provided with the screens required. Besides these deviations of the cylindrical shape from manufacturing are the inside of the digester wall exposed to both erosion and formation of deposits during operation of the digester.

Conventionally, this type of screens are mounted so that the step-out which increases the diameter of the pressure vessel is provided with a screen surface below the step-out such that the internal diameter of the vessel above the step-out is the same or smaller than the internal diameter at the screen area, and below a screen surface is the pulp column allowed to expand in a step-out from the screen area and towards the inside of the pressure vessel. This step-out below a screen surface is made in order to allow the chip column to expand as it may have been compacted over the screen surface during treatment liquor withdrawal. If more than one screen row is arranged in connection with such a step-out is also a smaller step-out arranged between a first upper screen row and a second screen row below, allowing the pulp column to expand and thus improve withdrawal capacity in the second screen row.

Forces directed to the surface of screens are usually arranged to be transmitted to the cover of the pressure vessel by means of two kinds of support system.

The first kind of support system is used preferably in sturdy self supporting screens where support only is obtained by a frame bed surrounding a rectangular screen area. This kind of support system has preferably been used for profile bar screens. By such support system could the withdrawal space behind the screens collecting the withdrawn treatment liquor avoid any obstructions which may accumulate deposits, and the withdrawal flow of treatment liquor could be maintained at full capacity over time.

The second kind of support system, preferably used for slotted screen plates, are support rods, i.e. bars of specific length fixed to the screen plate, arranged between the screen plate and the inside wall of the pressure vessel. This second kind of support system use a multitude of support rods each having to be adjusted to the specific curvature of the vessel wall in order to obtain a support. The asymmetry of the inside wall of the digester's pressure vessel tend to cause problems. Due to the deviations of the cylindrical shape of the pressure vessel, a considerable number of support rods are not supported onto the vessel wall, but at their one end, the support rods are hanging freely in the liquor collection chamber formed behind the screen, which collection chamber is formed between the screen and the interior wall of the pressure vessel. The object of transmitting forces directed to the screen construction to the inner wall of the digester vessel is thus not always achieved by using support rods. Because of the disadvantageous force stress the support rods bend and the screen twists, even breaks. In order to solve this problem could these support rods be made adjustable in order to avoid this problem, which requires a time consuming procedure for adjusting each individual support rod. Installation and replacement of such screen plates with adjustable support rods will be a rather time consuming process.

Examples of above described solutions could be found in prior art patents.

In US2003/0095901 is shown a support system for screen plate wherein adjustable support pins are used.

In US 2005/0284594 is shown a support system for sturdy self supporting profiled bar screens using circular profile bar rods. The profile bar screen is supported by a frame bed surrounding the screen, and horizontal support arches having integrated support shoulders are located at a distance from the digester wall in order to allow a certain ability to move. Similar profiled bar screens is also shown in U.S. Pat. No. 6,889,851 having adjustable support pins.

In U.S. Pat. No. 5,827,401 is shown yet a support system for sturdy self supporting profiled bar screens using T-shaped profile bar rods, but applied in circular screens. In this design is the force on the screen profile bars transmitted first to a support arch behind rods, and then further to a frame bed located around the circular screen.

In WO 95/16817 is yet another support system for sturdy self supporting profiled bar screens using T-shaped profile bar rods, but here using horizontally oriented profile bar rods.

In WO2013105888 is disclosed another self-supporting system for digester screens where the support arch has integrated support shoulders finding support in the outer digester wall at regular intervals and having a slot trough the support shoulders enabling a local deformation such that the support shoulders may find direct contact with the digester shell.

Profile bar screens are most often preferred as the total withdrawal area (I.e. slot area) are larger than for slotted screen plates, hence the withdrawal capacity per surface area could be higher. However, these profile bar screens are most often made with a sturdy self supporting design where all the force is transmitted to digester wall by a supporting frame bed.

One more advantage with profile bar screens is that if these have vertical profile bars with vertical slots in-between, could the slots be subjected to a continuous rubbing action from the descending pulp column keeping the slots free from any obstructions, and lower ends of these profile bars could have an unobstructed slot ending allowing any chip fragments caught in a slot from escaping out and away from the slots by the pushing action from the pulp column.

In digesters having screen areas equipped with screen plates and a multitude of support rods between screen plate and digester vessel wall, are no sturdy frame bed structure at hand which may be used to install sturdy self supporting profiled bar screens. If a profiled screen bar is to be installed in such digester it must have the same support structure with a multitude of support rods, and installation and adaption of each individual support rod becomes time consuming and thus costly. Moreover, flush out of sedimentations behind such screens with support rods during annual shut down for service work becomes difficult as the high pressure jet lances used must penetrat between all rods and direct the flushing action towards each pin. Otherwise must a new frame bed structure be welded into place which is a time consuming process, besides adding additional costs for the frame bed. This requires the mill operator to shut down the digester during annual overhaul work much longer than necessary, if new screens are to be installed.

BRIEF DESCRIPTION OF THE INVENTION

It is an object of the present invention to prevent the problems in existing solutions when installing profile bar screens in cylindrical digester vessels, such that a still sturdy profile bar screen might be installed quicker and with optimum load support. According to the invention the profiled bar screen could be installed as a replacement screen also in digesters where originally slotted screen plates have been used, and where load support instead has been obtained with a multitude of support pins on the backside of the slotted screen plates, thus having a weaker surrounding frame bed. Previously, when replacing slotted screen plates with profiled bar screens, the entire surrounding frame bed had to be rebuilt, as the profiled bar screens most often had its only load support in surrounding frame bed.

In order to enable installation also of profile bar screens in screen beds with weaker screen frames, some profiled bar screen also had a multitude of support pins on the backside of the profiled bar screen. Those support pins typically located between support arches and inside of digester wall. But this usage of support pins had the inherent disadvantage with a tedious and time consuming task to adapt the length of each individual support bar. Replacement of digester screens are typically installed during shut down of the digester and the entire pulp production line, which calls for a design enabling an efficient and fast process as any hour of shut-down causes great losses in income from pulp sales.

According to the invention is thus provided for a profile bar screen for draining treatment liquor from a suspension of comminuted cellulose material and treatment liquor in an essentially cylindrical digester vessel, said profile bar screen being arranged inside the outer wall 1 of the digester vessel forming a withdrawal chamber 20 between the wall of the digester vessel and the profile bar screen, the profile bar screen comprising:

- vertical profile bar elements 10 facing the suspension of comminuted cellulose material, said vertical profile bars arranged in parallel to each other and forming a withdrawal slot 15 for treatment liquor between neighboring profile bars;
- several horizontal support arches 11 having vertical mounting slots for holding a profile bar element in said mounting slots, the horizontal support arches having integrated support shoulders 12 resting against the inside of the outer wall of the cylindrical digester vessel, and each support arch has only two integrated support shoulders located at each respective end of the support arch such that the support arch between support shoulders is located at a distance from the outer digester wall 1 enabling a free unobstructed flow of withdrawn cooking liquor between digester wall and support arch and between support shoulders in each support arch.

This solution enables a quick installation of the new screen in a digester without having to make any alterations of the pressure vessel wall, and associated 3$^{rd}$ party testing of new welds. Using only 2 support shoulders in each end of the support arch also provides for path of flow lacking all potential sedimentations on pins or additional support shoulders between ends of the support arch.

Further, according to a preferred embodiment is each support arch with the two integrated support shoulders made in one single piece from a metal plate with a thickness in the range of 12-18 mm, preferably about 15 mm, said support arch and integrated support shoulders being cut from said metal piece, preferably using water jet or laser cutting. This provides for an less costly and less complicated design of the screen to manufacture.

In yet a further embodiment is also included in said screen a L-shaped frame 82 with a first and second leg part arranged orthogonally towards each other is attached to the support arch, with the first leg attached to the support arch, preferably by welding, and oriented in the radial direction of the digester and the second leg oriented in the circumferential direction of the digester and with the inwardly facing side of the second leg being flush with the surface of the vertical profile bar elements 10 facing the suspension of comminuted cellulose material kept inside the digester and the outwardly facing side of the second leg abutting a support bar 81 finding final load support in the digester wall. The L-shaped frame provides for a quick confirmation that the support shoulders may need grinding off if the L-shaped frame, due to uneven digester wall, does not come into contact with the support rod to which it is intended to be attached to by welding. If the distance is lets say 3 mm between the L-shaped frame and the support bar, then the support shoulder needs to be ground off the same length.

In another embodiment is the horizontal support arches of the profile bar screen equipped with additional expansion slots having an open end facing towards the interior of the digester vessel and a closed end in the area of a support shoulder, allowing a flexibility of the horizontal support arches such that support shoulders may rest against the wall of the digester vessel despite any local deviations from a perfect cylindrical shape of the digester vessel wall. The design per se is known from WO2013105888, but is more important to use when having only support shoulders at ends of the support arch, as no other flexing is possible over the length of the support arch. Stress analysis has shown that the largest stress forces developed are those close to support bars, which in themselves are rigid and non flexable.

BRIEF DESCRIPTION OF THE FIGURES

In the following a preferred embodiment of the invention will be described with reference to the attached drawing, in which FIG. 1 shown a continuous digester with cut-away sections in 2 screen areas of the digester.

DETAILED DESCRIPTION OF THE PREFERRED EMBODIMENT

Figure 1:
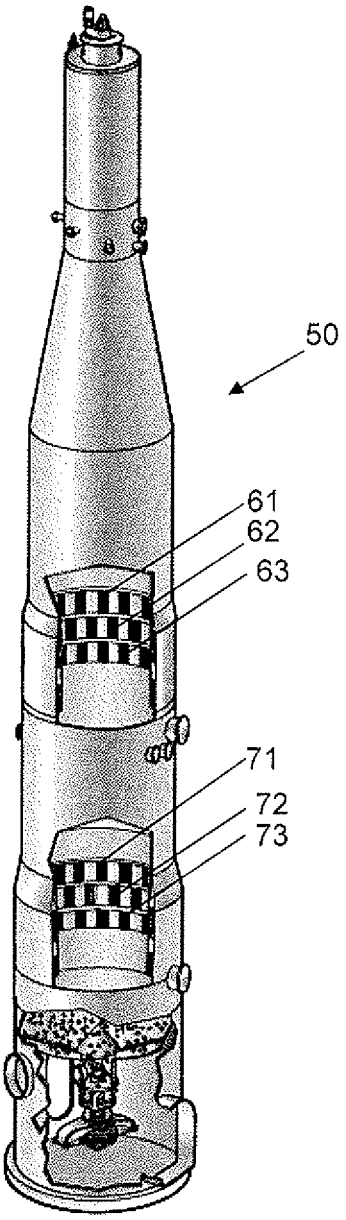
Fig. 1 Prior art

In FIG. 1 is shown a tall and cylindrical continuous digester of a conventional design, with in feed of comminuted cellulose material in upper part and out feed of cooked pulp in bottom. The digester is shown with cut-away sections in 2 screen areas of the digester. In the upper cut-away section are three screen rows shown. Here is the screen area designed with the "checkered" screen area, i.e. with alternating blind plates and screens 61, 62, 63 in each screen row.

The same "checkered" screen area is shown in the lower cut-away section, also with 3 screen rows with alternating blind plates and screens 71, 72, 73 in each screen row.

Essentially the same withdrawal capacity could be obtained with such "checkered" screen if profile bar screens are used instead of slotted plates, as profile bar screens have larger open slot area. The main problem with withdrawal capacity lies in the flow resistance trough the chip (or pulp) bed inside the digester, which could be very high in digesters with a diameter of 10-14 meter. So, a profile bar screen with "checkered" screen area could have same withdrawal capacity as a screen row with slotted screen plates all around the circumference, as the screens are located only some 700-1000 mm apart, which distance is neglect able compared to chip bed distance to center of vessel.

Figure 2:
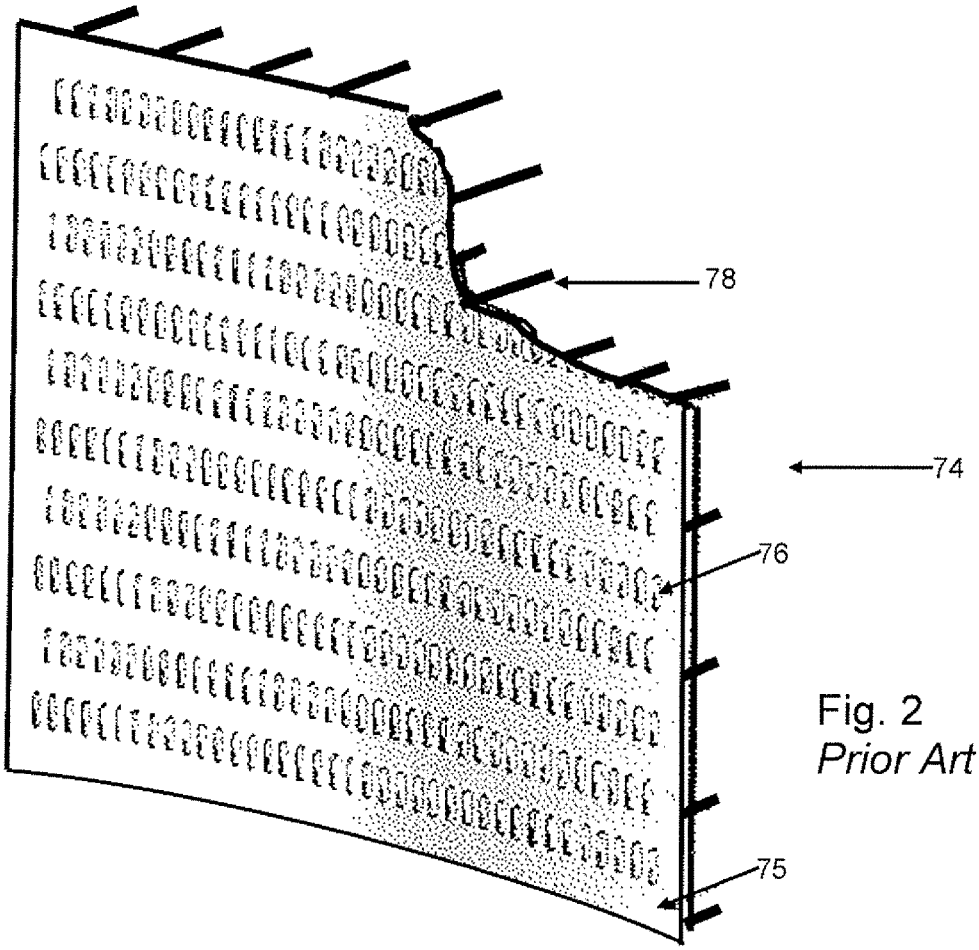
Fig. 2 Prior Art
FIG. 2 shows a slotted screen plate according to prior art.

In FIG. 2 is shown a conventional slotted screen plate 74 according to prior art. A metal plate 75 is equipped with withdrawal slots 76 which are made by either machine milling or water cutting jet technique. The entire screen plate is only supported by a multitude of support rods 78.

Figure 3:
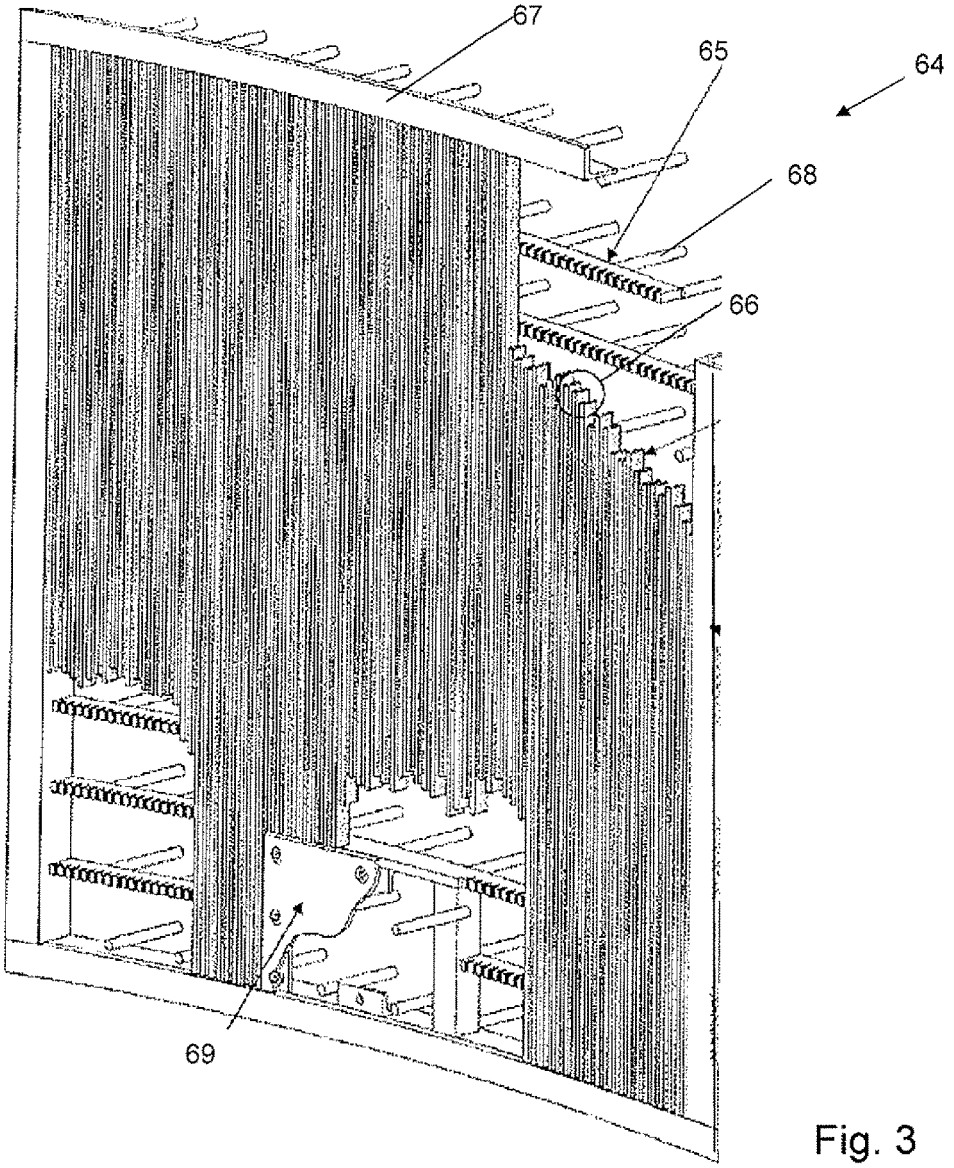
Fig. 3 Prior Art
FIG. 3 shows a profile bar screen according to prior art.

In FIG. 3 is shown a conventional profile bar screen 64 according to prior art. Profile bars 66 are supported by horizontal support arches 65, which in turn is supported by a multitude of support rods 68. Here is also shown a clean-out plate 69, which could be opened in order to clean out the lower part of screen assembly. Both these type of screens are shown on page A537 in "Chemical Pulping", book 6A (1999), ISBN 952-5216-06-3, as screens promoted by Ahlstrom Machinery (now Andritz).

Figure 4:
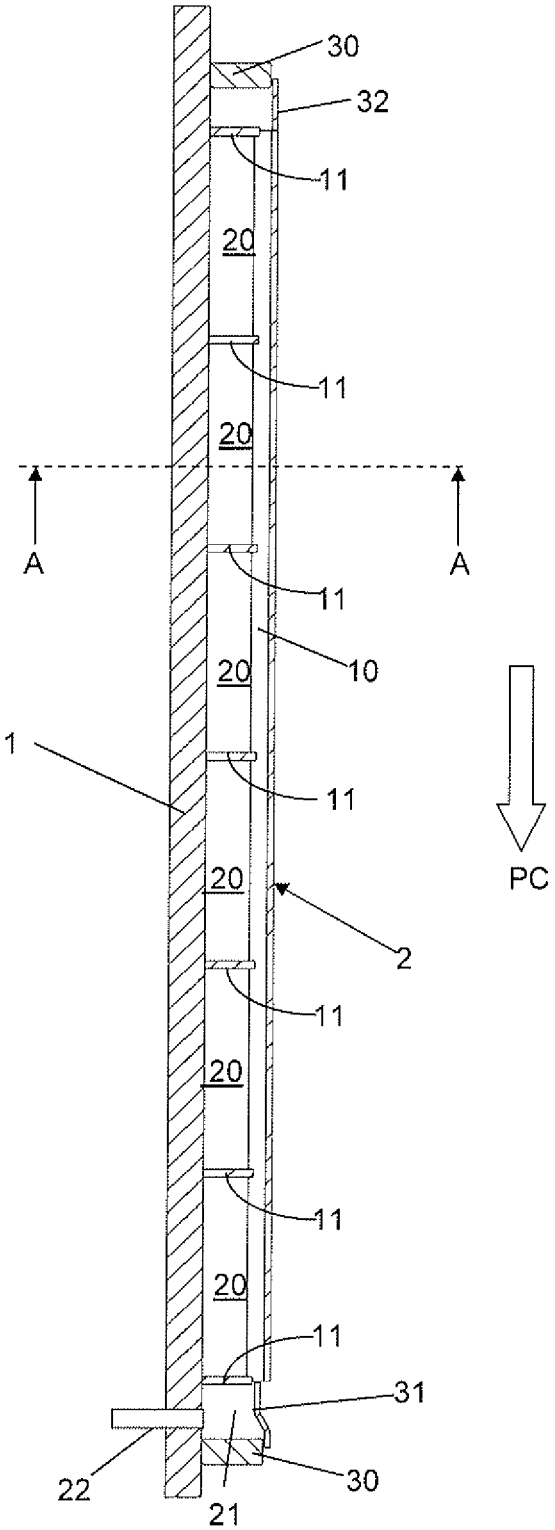
Fig. 4 Prior art
FIG. 4 shows an alternative profile bar screen in a vertical section view according to prior art.

In FIG. 4 is shown a profile bar screen according to WO2013/105888 as mounted in a continuous digester. The digester wall 1 is the actual pressure vessel wall and inside of the wall is the profile bar screen 2 located with vertical profile bar elements 10 facing the suspension of comminuted cellulose material as it descends down through the digester as a pulp column in the downwards direction PC. The vertical profile bar elements 10 are mounted on several horizontal support arches 11 located preferably at a set vertical distance between each support arch 11. Thus, the force upon the profile bar screen from the pulp column is first exposed to the profile bar elements 10 and via support arches 11 to the inside of the digester wall 1.

As indicated could a blind plate 32 be located above the screen bar elements 10, supported on a horizontal thrust beam 30. The upper blind plate 32 has its inwardly facing surface located flush with the inwardly facing surface of the screen bar elements, allowing the descending pulp column to descend without any obstructions to the bar screen area.

Below the profile bar elements 10 is a guide plate 31 mounted, which in its upper part has a retracted position allowing any chip fragments caught in slots between the profile bar elements from being pushed out from the slots as the pulp column descends.

The withdrawn treatment liquor is collected in a number of withdrawal chambers 20 between the profile bar elements 10 and the inside of the digester wall. The withdrawal chambers 20 are all in fluid communication with each other and withdrawn treatment liquor will finally be collected in a header chamber 21 located below chambers 20 before being withdrawn from the digester trough an outlet 22.

Figure 5:
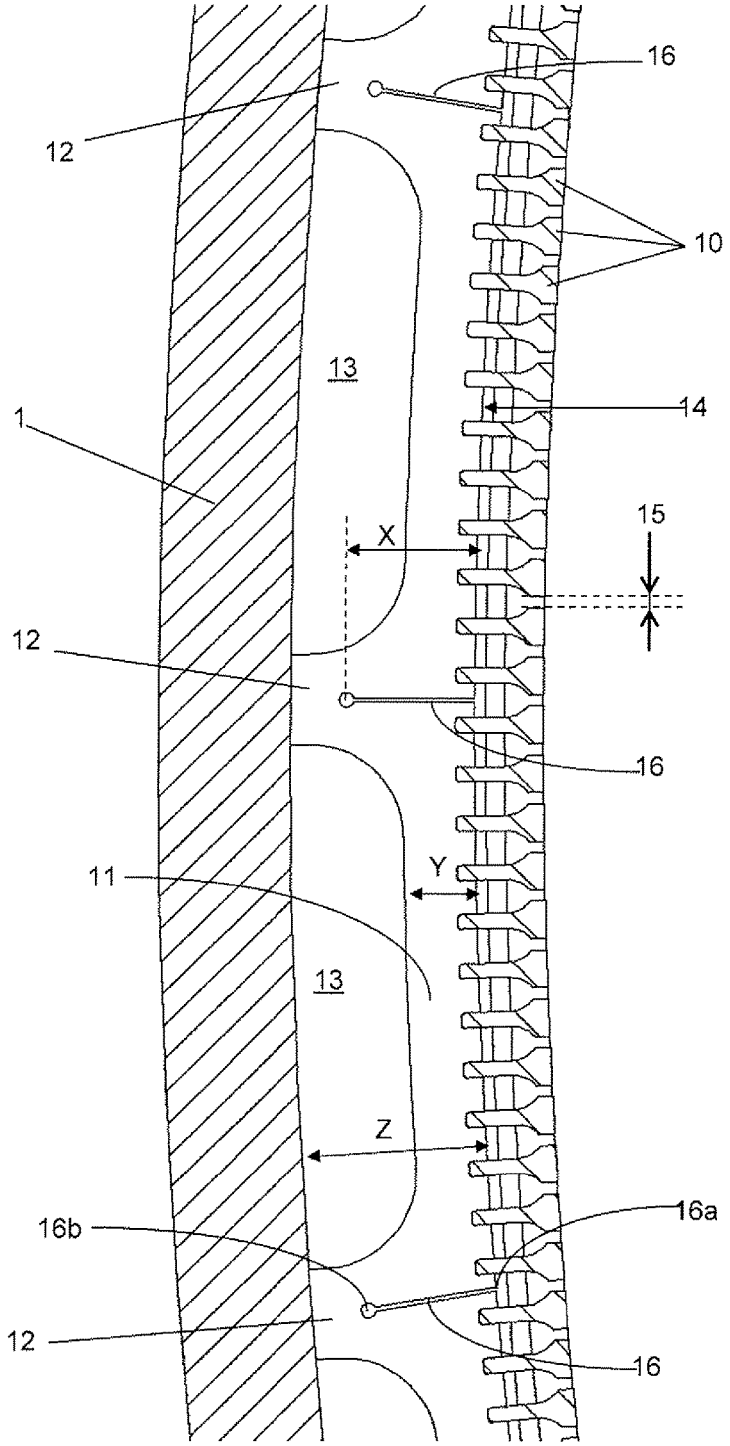
Fig. 5 Prior art
FIG. 5 shows the profile bar screen as seen in section A-A in FIG. 4 according to prior art.

The features of the profile bar screen as shown in WO2013105888 are shown in FIG. 5. The support arches 11 has on the surface 14 facing the interior of the digester vertical mounting slots for holding a profile bar element 10 (only 3 profile bar elements numbered in figure) in said mounting slots. The profile bar elements have a T-shaped form. The bottom part of the T-shaped profile bar element is mounted in the vertical mounting slots of the horizontal support arches, with the upper flat face of the T-shaped vertical profile bar facing the inside of the treatment vessel and the suspension of comminuted cellulose material contained therein.

A withdrawal slot 15 is thus formed between profile bar elements 10. The screen slot size is varying from some 5-6 mm in upper part of digester and down to some 3 mm in lower part of digester, as the cellulose material is subjected to increased delignification and softening during cooking in the digester and slot size needs to be smaller in the final phases of the cook.

The horizontal support arches 11 further have integrated protruding support shoulders 12 resting against the inside of the outer wall 1 of the cylindrical digester vessel, and in FIG. 5 are 3 such support shoulders 12 shown, each located some distance apart creating an open flow channel 13 connecting the withdrawal chambers 20 to each other.

According to WO2013105888 are the horizontal support arches 11 equipped with additional expansion slots 16 having an open end 16*a* facing towards the interior of the digester vessel and a closed end 16*b* in the area of a support shoulder 12, allowing a flexibility of the horizontal support arches such that all support shoulder may rest against the wall of the digester vessel despite any local deviations from a perfect cylindrical shape of the digester vessel wall.

In the shown embodiment could some 12 profile bar elements be mounted between 2 neighboring expansion slots, but could be as few as 10 or as many as 20. The non flexing part of the support arch would thus hold the profile bar elements fixed in relation to each other and the withdrawal slot 15 thus kept constant. The withdrawal slot 15 coincident with the expansion slot 16 would instead allow some alteration of the slot width as the support arch will flex. However, the impact of this alteration is low, and if for example 10 profile bar elements are mounted between two expansion slots will only 10% of slot area be subjected to alteration due to flexing of the support arch. The relative alteration of individual slots will decrease with less profile bar elements between expansion slots as flexing due to uneven cylindrical form of vessel will be distributed over more expansion slots.

The expansion slots preferably has a depth X trough the horizontal support arches exceeding the depth Y of the horizontal support arches 11 in the area of the support arches wherein no support shoulder is located radially outside of the support arches.

The length X of the expansion slots preferably exceeds 50% of the total depth Z of the horizontal support arches 11, as counted from the inwardly facing surface 14 of the support arches 11 and to the outwardly facing surface of the support shoulder 12 of the support arches 11.

The depth of the support shoulder (Z-Y in FIG. 5) could vary depending upon the depth of the chambers 20 in each individual digester.

In order to avoid stress cracking due to local stress load as the support arch 11 will flex is the closed end 16*b* of the expansion slot preferably widened with an essentially circular slot part with a radius exceeding 4 millimeter as shown in principle in FIG. 5.

The expansion slot 16 could have a width being substantially constant before mounting the profile bar screen in said digester vessel or alternatively have a larger width at the open end 16*a* facing towards the interior of the digester vessel than the width at the closed end 16*b* before mounting the profile bar screen in said digester vessel. The alternative with increasing width towards open end 16*a* could preferably be used when the digester vessel is expected to have a form that deviates more from a perfect cylindrical form, thus needing more flexing in the support arch 11. Thus, with increasing width the slot could be some 1 mm at closed end 16*b* and some 2-4 mm at open end 16*a*.

Figure 6A:
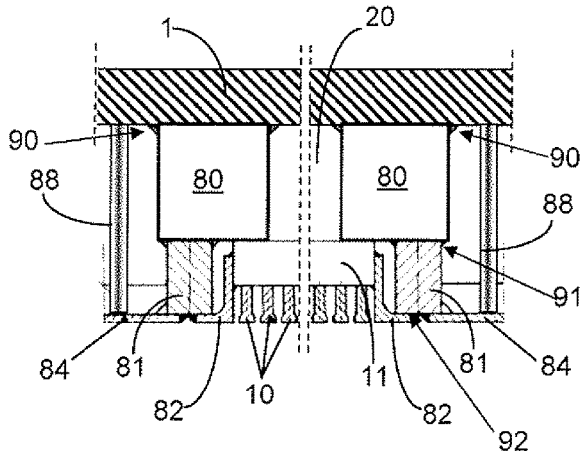
Fig. 6a Prior Art
FIG. 6*a* shows yet another profile bar screen as installed in a screen row with "checkered design" as shown in FIG. 1 with a blind plate in each second screen compartment.

In FIG. 6*a* is disclosed a screen design as used according to prior art in checkered screen rows as disclosed in FIG. 1. In this design is the screen comprising a self-supporting sturdy support arch 11, having slots for mounting the individual screen bars 10. A L-shaped frame 82 surrounds the screen area, attached to the support arch by fillet welds. The support arch 11 finds its load support in a number of support members 80 welded to the digester wall with fillet welds 90. There are typically a multitude of support members 80 located over the height of the screen, and in numbers corresponding to the number of support arches 11 shown in FIG. 4. As each such support member 80 is welded to a part of the pressure vessel, each weld 90 has to be inspected by a third party certification member for appropriate approval of the pressure vessel design. The fillet weld also prevents penetration of corrosive cooking liquors between the support members 80 and the pressure vessel wall 1, and needs to be continuous around the entire support member. Such inspection needs most often crack inspection of the weld 90 using either penetrants or magnaflux methods or similar, thus needing extensive time and review for all welds. There is also a vertical support bar 81 which provides support for the L-shaped frame 82, with a fillet weld 92 around the circumference of the L-shaped frame, and with a fillet weld 91 attached firmly to the support member 80. A screen section could thus be replaced if needed without any changes in the pressure vessel wall design, as only welds 92 need to be removed with a grinding disc or similar. The support members 80 are only extended towards the withdrawal compartment 20 such that necessary support area is obtained for the support arches 11. In the next compartment, covered by a blind plate 84, the blind plate has support pins 88 arranged in a similar way as disclosed in FIG. 2.

Figure 6B:
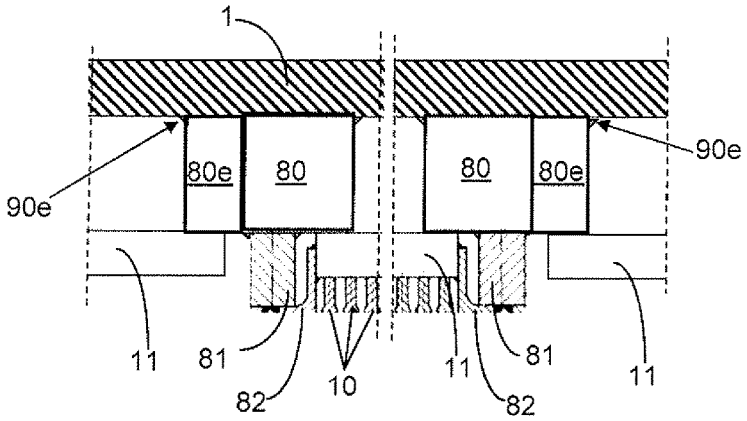
Fig. 6b Prior Art
FIG. 6B shows how a screen row design according to FIG. 6*a* may be modified according to prior art with screens also in compartments that previously have had blind plates.

Now, if the operating conditions of the digester need increased withdrawal capacity there is an option to replace the blind plates with screen sections. How this is conventionally implemented is shown in FIG. 6*b*, where the blind plate 84 is removed. What is needed here is an additional support member 80*e* extending the support area for new support arch 11 stretching over the compartment previously covered by a blind plate. The L-shaped frame 82 and the individual screen bars 10 are not shown in this drawing for the new screen, but is of course included in the final design. The additional support member 80*e* needs to be welded around the entire circumference with a fillet weld 90*e*. This conventional design has the drawbacks that the welding work is time consuming and the additional welds needs thorough inspection before approval as a change in the pressure vessel design is made, besides high expenses for welding material/electrodes. In a typical digester with 4 screen rows needing replacement of the blind plates, FIG. 1 show 6 screen rows with checkered screen area, is over 1000 support members installed, thus requiring installation of over 1000 additional support members 80*e*. A certified welder may apply one weld for one additional support member in 5-10 minutes, and hence the total welding work alone may require in excess of 100-200 man hours. Then the necessary time for inspection using penetrant or magnaflux methods may require additional time in the same order. After inspection work could the installation of the new screens start, which takes additional time to complete the rebuild.

This amount of time is normally not available in the short down time of a digester where maintenance or rebuild work needs to be finished.

Figure 7:
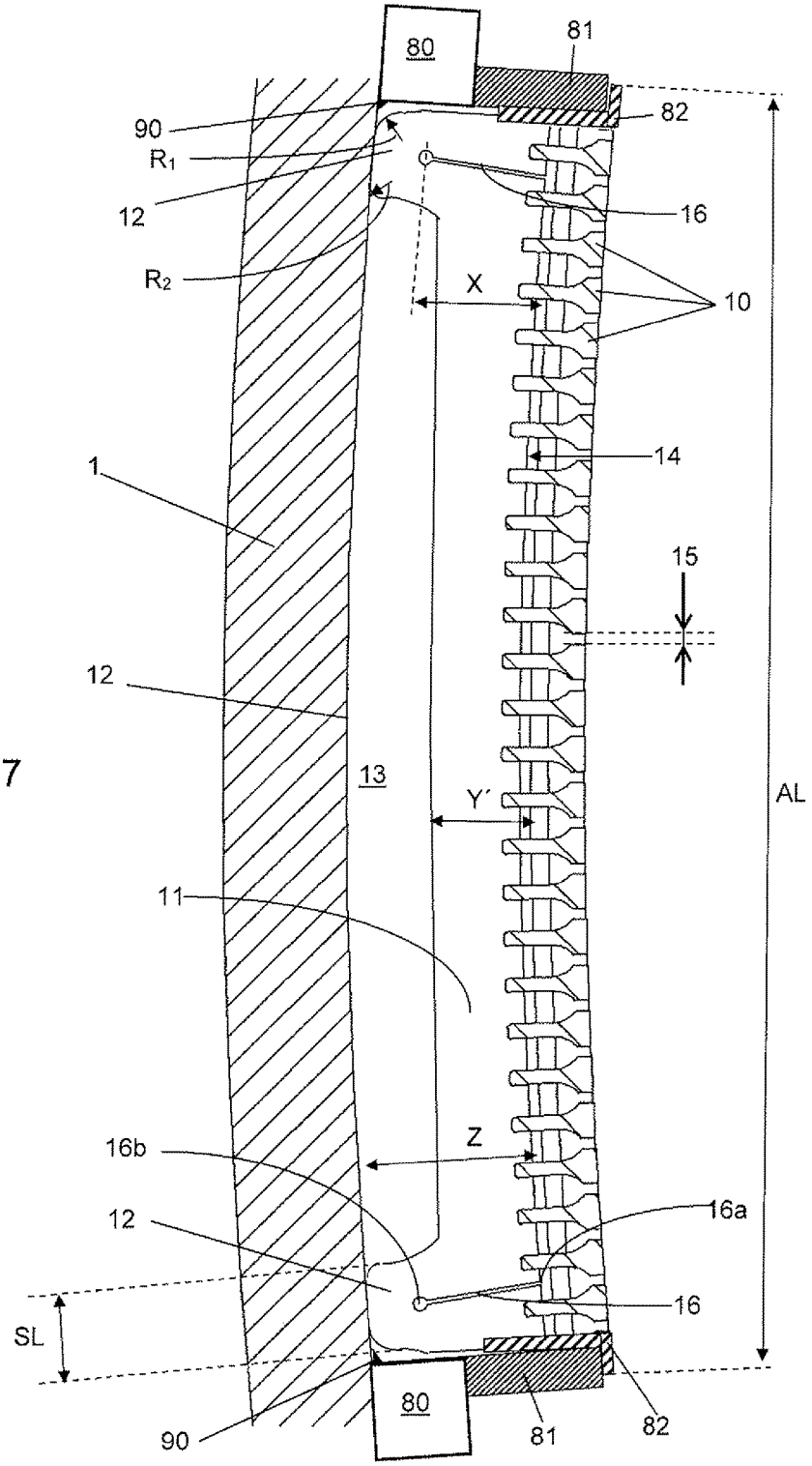
FIG. 7 show a screen design according to the invention.

The inventive screen design is shown in FIG. 7, and avoid any alterations in the digester shell when installing the new screen. As no changes in the pressure vessel is made, no welds need to be inspected by a third party certification member for appropriate approval of the changed pressure vessel design. The screen design is similar to that disclosed in WO2013105888 but differs in that only two support shoulders 12 are located at each end and integrated with the support arch 11. The support arch 11 is preferably made with somewhat larger dimension Y' than the corresponding dimension Y in FIG. 5, and the thickness of the support arch 11 is preferably extended from some 8 mm to about 15 mm. As indicated previously has not the digester a perfect circular form so the distance between the inner facing side of the support bar 81 and the inside of the digester wall 1 may change, but this may be compensated by delivering the screen with somewhat oversized support shoulder 12 in the radial direction. If the outer L-shaped frame 82 is not abutting the support bar 81, could excess material easily be ground off from the support shoulder at site, and as there are only 2 support shoulders on each support arch 11 is less adjustment time necessary during installation. Besides a dramatic reduction in necessary installation time will the screen design according to the invention provide with less hindrance for the downward flow of the withdrawn spent cooking liquors in the withdrawal compartment 20, and less amount of surfaces where the spent cooking liquors could form depositions precipitated from the spent cooking liquors.

The entire support arch 11 and integrated support shoulders 12 is preferably made in one single piece, preferably cut from about 15 mm thick metal plates using water jet or laser cutting techniques.

The invention is preferably applicable for screens with an arch length AL in the circumferential direction of the digester in the range of 200-600 mm. The screens are in a first installation made with an arch length of about 495 mm and expected to be put into operation late 2014.

The length SL in the circumferential direction of the digester of the support shoulders 12 when made from a single sheet metal piece are preferably in the range 20-60 mm, preferably 40 mm, and in relation to the total arch length AL less than 10%, leaving a large unhindered flow channel 13 between support shoulder 12 less exposed for sedimentations to build up.

In a most preferred embodiment is the outer edge of the support shoulder closest to digester wall and closest support member 80 designed with a large radius $R_1$ that provides clearance to any fillet welds 90, and said radius exceeding 10 mm, preferably 15 mm. The inner edge of the support shoulder closest to flow channel 13 and furthest away from the support member 80 is preferably designed with a smaller radius $R_2$, and said radius exceeding 3 mm, preferably 5 mm and at the most same as $R_1$. The object of the smaller radius is to avoid a sharp edge from penetrating the pressure vessel wall 1. The clearance between outer edge of support shoulders 12 and support member 80 should preferably be kept at a minimum, and only made so large that it may accumulate any local dislocation of for example the support member in form of burrs or weld spots. No withdrawal flow is intended to be developed in this clearance and it will most likely be blocked by sedimentations after only a short time of operation, which will happen even if the clearance would be as large as 10-30 mm, at expense of reducing the major withdrawal flow channel 13.

But in an alternative solution could also the support shoulders be attached to the support arch as a separate piece, and preferably attached by welding. Alternatively could the support shoulders be designed as adjustable screws that after adjustment is locked by a weld, but both these alternatives result in a more expensive screen.

As is the case in the design according to WO2013105888 are the support arches 11 preferably equipped with additional expansion slots 16 having an open end 16*a* facing towards the interior of the digester vessel and a closed end 16*b* in the area of a support shoulder 12, allowing a flexibility of the horizontal support arches such that the 2 support shoulders may rest against the wall of the digester vessel despite any local deviations from a perfect cylindrical shape of the digester vessel wall.

It is to be understood that the above description and the related figures are only intended to illustrate the present solution. Thus, the solution is not restricted only to the embodiment described above and defined in the claims, but many different variations and modifications, which are possible within the scope of the idea defined in the attached claims, will be obvious to a person skilled in the art.

Thus the profile bar screen may preferably be used in other cylindrical pressure vessels such as digesters, either in continuous or batch digesters with a cylindrical form. In FIGS. 8*a*-8*d* are shown different types of profile bars that could be used.

Figure 8A:
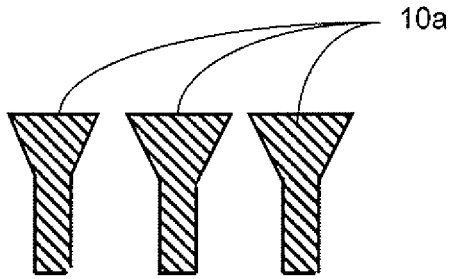
FIG. 8*a-d* shows different profile bars usable in the claimed invention.
Figure 8B:
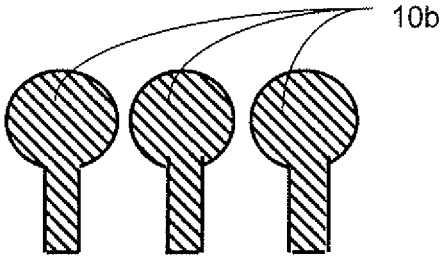

In FIG. 8*a* is shown a profile bar with vertical profile bar elements having a closed Y-shaped form, with bottom part of the Y-shape mounted in the vertical mounting slots of the horizontal support arches for holding a profile bar element in said mounting slots, and with the upper flat face of the closed Y-shaped vertical profile bar facing the inside of the treatment vessel and the suspension of comminuted cellulose material contained therein.

In FIG. 8 *b* is shown a profile bar with vertical profile bar elements 10*b* having a circular form facing the interior of the digester, with an integrated flat bar portion at its bottom part mounted in the vertical mounting slots of the horizontal support arches for holding a profile bar element in said mounting slots, and with the upper faces of the circular bars facing the inside of the treatment vessel and the suspension of comminuted cellulose material contained therein.

Figure 8C:
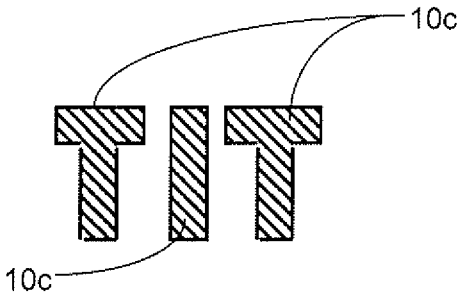

In FIG. 8*c* is shown a profile bar with vertical profile bar elements 10*c* having a T-shaped form, with bottom part of the T-shaped bar mounted in the vertical mounting slots of the horizontal support arches for holding a profile bar element in said mounting slots, and with the upper flat face of the T-shaped vertical profile bar facing the inside of the treatment vessel and the suspension of comminuted cellulose material contained therein. But in this embodiment is each second bar element a flat bar element 10*c'*.

Figure 8D:
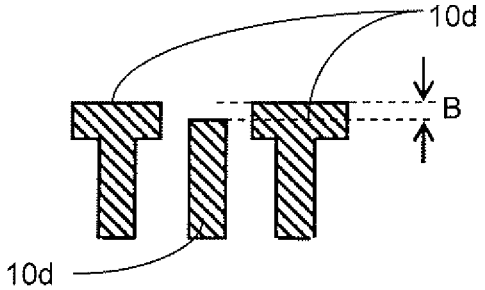

In FIG. 8*d* is shown an alternative profile bar arrangement according to FIG. 8*c*, but where each second bar element is recessed a distance B from the upper flat face of neighboring T-shaped bar elements.

The invention claimed is:

1. A profile bar screen for draining treatment liquor from a suspension of comminuted cellulose material and treatment liquor in an essentially cylindrical digester vessel having an outer wall, said profile bar screen being arranged inside the outer wall of the cylindrical digester vessel thereby forming a withdrawal chamber between the outer wall of the digester vessel and the profile bar screen, the profile bar screen comprising:

vertical profile bar elements facing the suspension of comminuted cellulose material, said vertical profile bar elements arranged in parallel to each other and forming a withdrawal slot for treatment liquor between neighboring ones of said vertical profile bar elements; and a plurality of horizontal support arches having vertical mounting slots for mounting said vertical profile bar elements in said mounting slots, the plurality of horizontal support arches having integrated support shoulders resting against the inside of the outer wall of the cylindrical digester vessel, each of said plurality of horizontal support arches having only two of said integrated support shoulders located at each respective end of each of said plurality of support arches whereby the plurality of horizontal support arches between said integrated support shoulders is located at a distance from the outer wall of the cylindrical digester vessel, enabling a free unobstructed flow of withdrawn cooking liquor between said outer wall of said cylindrical digester vessel and said plurality of horizontal support arches and between said two integrated support shoulders in each of said plurality of horizontal support arches.

2. The profile bar screen as claimed in claim 1, wherein each of said plurality of horizontal support arches including the two integrated support shoulders comprises a single piece made from a metal plate with a thickness in the range of from 12- to 18 mm.

3. The profile bar screen as claimed in claim 2, including a support bar for said outer wall of the cylindrical digester vessel and an L-shaped frame with a first leg and a second leg arranged orthogonally towards each other attached to the plurality of horizontal support arches and having an inwardly facing side and an outwardly facing side, with the first leg attached to the plurality of horizontal support arches, and oriented in the radial direction of the cylindrical digester vessel and the second leg oriented in the circumferential direction of the cylindrical digester vessel, and with the inwardly facing side of the second leg being flush with the surface of the vertical profile bar elements facing the suspension of comminuted cellulose material kept inside the digester and the outwardly facing side of the second leg abutting the support bar finding final load support in the outer wall of the cylindrical digester vessel.

4. The profile bar screen as claimed in claim 3, wherein said plurality of horizontal support arches include expansion slots having an open end facing towards the interior of the cylindrical digester vessel and a closed end in the area of one of said integral support shoulders, thereby allowing for a flexibility of the plurality of horizontal support arches such that said integrated support shoulders may rest against the outer wall of the cylindrical digester vessel despite any local deviations from a perfect cylindrical shape of the outer wall of the cylindrical digester vessel.

5. The profile bar screen as claimed in claim 2, wherein the length of the plurality of horizontal support arches in the circumferential direction of the cylindrical digester vessel of the screen is in the range of from 200- to 600 mm.

6. The profile bar screen as claimed in claim 5, wherein the length of the plurality of support shoulders in the circumferential direction of the cylindrical digester vessel is in the range from 20- to 60 mm, and is less than 10% in relation to the length of the plurality of horizontal support arches, thereby providing a large unhindered withdrawal flow channel between said integrated support shoulders providing less exposure for sedimentation to build up.

7. The profile bar screen as claimed in claim 6, wherein the length of the plurality of horizontal support arches is about 40 mm.

8. The profile bar screen as claimed in claim 6, wherein the plurality of horizontal support arches are produced from a simple piece of sheet metal.

9. The profile bar screen as claimed in claim 5, including a plurality of support members welded to a part of said outer wall of said cylindrical digester vessel by means of fillet welds, and wherein the integrated support shoulders includes an outer edge closest to outer wall of the cylindrical digester vessel and a closest one of said support members includes a large radius that provides clearance to any of said fillet welds, said large radius exceeding 10 mm.

10. The profile bar screen as claimed in claim 9, including a plurality of support members welded to a part of said outer wall of said cylindrical digester vessel, wherein the integrated support shoulders include an inner edge closest to the large unencumbered withdrawal flow channel and furthest away from a closest one of said plurality of support members includes a smaller radius exceeding 3 mm, no larger than said large radius.

11. The profile bar screen as claimed in claim 2, wherein the plurality of horizontal support arches have a thickness of about 15 mm.

12. The profile bar screen as claimed in claim 2, wherein said plurality of horizontal support arches are cut from said single piece by means of water jet or a laser.

* * * * *